US009315981B2

(12) United States Patent
Anastasio et al.

(10) Patent No.: US 9,315,981 B2
(45) Date of Patent: Apr. 19, 2016

(54) SEPARATOR MODULE FOR A STORMWATER GULLY CHAMBER

(71) Applicant: Hydro International plc, Clevedon (GB)

(72) Inventors: Andrew Scott Anastasio, Portland, ME (US); Anthony Tadek Leslie Kolanko, Bristol (GB); Kevin John McKee, Scarborough, ME (US); Andrew Steven Kane, North Somerset (GB); David Andrew Scott, Portland, ME (US)

(73) Assignee: Hydro International PLC, Clevedon (GB)

( * ) Notice: Subject to any disclaimer, the term of this patent is extended or adjusted under 35 U.S.C. 154(b) by 165 days.

(21) Appl. No.: 13/967,078

(22) Filed: Aug. 14, 2013

(65) Prior Publication Data

US 2015/0048014 A1 Feb. 19, 2015

(51) Int. Cl.
*E03F 5/14* (2006.01)
*E03F 5/04* (2006.01)

(52) U.S. Cl.
CPC ..... *E03F 5/04* (2013.01); *E03F 5/0403* (2013.01); *E03F 5/14* (2013.01)

(58) Field of Classification Search
CPC ..... E03F 5/04; E03F 5/0403; E03F 5/0404; E03F 5/041; E03F 5/14
USPC ..... 210/170.03, 232, 254, 532.1
See application file for complete search history.

(56) References Cited

U.S. PATENT DOCUMENTS

| | | | | |
|---|---|---|---|---|
| 5,405,539 | A * | 4/1995 | Schneider | 210/170.03 |
| 5,753,115 | A * | 5/1998 | Monteith | 210/170.03 |
| 5,849,181 | A * | 12/1998 | Monteith | 210/170.03 |
| 6,062,767 | A * | 5/2000 | Kizhnerman et al. | 210/170.03 |
| 6,068,765 | A * | 5/2000 | Monteith | 210/170.03 |
| 6,149,803 | A * | 11/2000 | DiLoreto et al. | 210/170.03 |
| 6,254,770 | B1 * | 7/2001 | Remon | 210/163 |
| 6,264,835 | B1 * | 7/2001 | Pank | 210/170.03 |
| 6,743,354 | B1 * | 6/2004 | Evans et al. | 210/170.03 |
| 7,314,549 | B2 * | 1/2008 | Swift | 210/170.03 |
| 7,344,636 | B2 | 3/2008 | Faram et al. | |
| 7,922,916 | B1 * | 4/2011 | Witt | 210/170.03 |
| 2004/0188357 | A1 | 9/2004 | Moore | |
| 2011/0278237 | A1 * | 11/2011 | McInnis | 210/163 |

FOREIGN PATENT DOCUMENTS

| | | |
|---|---|---|
| WO | WO97/41316 | 11/1997 |

OTHER PUBLICATIONS

Search Report and Written Opinion for PCT/GB2014/052279 (mailed Nov. 11, 2014).

* cited by examiner

*Primary Examiner* — Christopher Upton
(74) *Attorney, Agent, or Firm* — Klarquist Sparkman, LLP

(57) ABSTRACT

A separator module for a stormwater gully chamber is disclosed, the separator module comprising: a partition arrangement which, in use, divides the chamber into an upper region and a lower region, the partition arrangement comprising: an inlet chute having an opening which, in use, provides an inlet to the lower region from the upper region; an outlet chute having an opening which, in use, provides an outlet from the lower region to the upper region; and a weir separating the outlet chute from the inlet chute; wherein at least a portion of the partition arrangement is flexible so as to allow an external diameter of the partition arrangement to be adjusted to fit different sized chambers.

11 Claims, 7 Drawing Sheets

SEPARATOR MODULE FOR A STORMWATER GULLY CHAMBER

BACKGROUND

This invention relates to a separator module for a stormwater gully chamber.

Conventional gullies under roadways and other paved areas comprise a chamber having inlet and outlet pipes which open into the chamber at a position above the bottom of the chamber. There may also be a top inlet, which provides access to the interior of the chamber through a grating provided at the roadway surface, for example in a gutter. In use, solids entering the chamber, whether from the inlet pipe or through the grating, collect under gravity in the base of the chamber and can be extracted at intervals by means of a suction pipe introduced into the chamber after removing the grating. Such gullies have a low separation efficiency. Furthermore, in the event of heavy storm flows, collected solids in the base of the chamber, and solids floating on the surface tend to be stirred up, and can pass into the outlet pipe.

A hydrodynamic vortex separator may be used to improve the separation efficiency of the gully. Such separators are suitable for removing sediment, litter and oil from surface water runoff.

FIG. 1 shows an example of a hydrodynamic vortex separator used in a stormwater gully, as disclosed in U.S. Pat. No. 7,344,636. The separator comprises an inlet compartment 3 and an outlet compartment 5 installed within a chamber 7. The inlet compartment 3 is connected to an inlet duct and the outlet compartment 5 is connected to an outlet duct. The inlet compartment 3 and the outlet compartment 5 are offset from one another around the circumference of the chamber 7 and are fluidically connected by a bypass duct 9.

An opening 11 is provided at the bottom of the inlet compartment 3 which serves as an inlet to the interior of the gully chamber 7. The inlet opening 11 is oriented so that inflowing liquid creates a circulating flow within the chamber 7 which assists in causing any solids within the incoming flow to accumulate and fall to the bottom of the chamber 7 or rise to the fluid surface depending upon their density. Similarly, the outlet compartment 5 has an opening which serves as an outlet from the interior of the chamber 7. The outlet opening is oriented so that outflowing liquid passes through the outlet opening in a direction opposite that of the circulating flow. The relative orientations of the inlet and outlet openings means that, even under conditions of heavy flow, solids will be swept past the outlet opening rather than leave the chamber.

A weir is provided between the inlet compartment 3 and the bypass duct 9 so that, in periods of heavy flow, only some of the flow entering the inlet compartment 3 will pass through the inlet opening 11, and the remainder will pass over the weir and through the bypass duct 9 directly to the outlet compartment 5.

Although the bypass duct 9 may be cut to an appropriate length so that the inlet and outlet compartments 3, 5 align with the inlet and outlet ducts, the bypass duct 9 must be made available in different radii of curvature to conform to chambers having different diameters. Further, the size, number and position of the ducts is restricted somewhat by this arrangement.

In addition, the inlet and outlet compartments 3, 5 and the bypass duct 9 limit the bypass capacity of the separator.

It is therefore desired to provide a separator module which addresses or alleviates some or all of these issues.

SUMMARY

In accordance with an aspect of the invention, there is provided a separator module for a stormwater gully chamber, the separator module comprising: a partition arrangement which, in use, divides the chamber into an upper region and a lower region, the partition arrangement comprising: an inlet chute having an opening which, in use, provides an inlet to the lower region from the upper region; an outlet chute having an opening which, in use, provides an outlet from the lower region to the upper region; and a weir separating the outlet chute from the inlet chute. At least a portion of the partition arrangement is flexible so as to allow an external diameter of the partition arrangement to be adjusted to fit different sized chambers.

The separator module may be particularly beneficial in the US and UK markets, where chambers are sized based on metric and imperial measurements respectively. The flexible nature of the partition arrangement may also provide an improved seal against the chamber.

The partition arrangement may comprise a partition plate and a separate ledger component which, in use, connects to an inner wall of the chamber. The ledger component supports the partition plate within the chamber such that the partition plate does not directly contact the chamber, the ledger component defining the external diameter of the partition arrangement. The ledger component comprises a discontinuous flexible annular ring having a gap which allows the ledger component to expand or contract so as to alter the external diameter of the partition arrangement.

The ledger component may be resiliently deformed when inserted into the chamber.

The partition plate and the ledger component may comprise complementary structures which interlock with one another. The complementary structures can fix the relative orientations of the partition plate and the ledger component. The complementary structures may, in particular, be formed by the weir plates described below.

The partition arrangement may comprise a partition plate and separate inlet and outlet chute components forming the inlet and outlet chutes respectively, the partition plate having first and second openings for receiving the inlet and outlet chute components and an axially extending central standpipe portion disposed between the first and second openings. The central portion comprises first and second slots extending axially from the first and second openings. The width of the first and second slots and thus the width of the first and second openings is adjustable so as to alter the external diameter of the partition arrangement.

The inlet and outlet chute components may each comprise a backing plate which is received within the central standpipe portion, the backing plates covering the first and second slots. The backing plates may therefore seal against the slots to prevent water from passing through them.

The inlet and outlet chute components may each comprise a pair of circumferentially extending flanges which abut the partition plate. The circumferentially extending flanges allow the width of the first and second openings to be adjusted and abut with the partition plate over the full range of movement.

The central standpipe portion may comprise a bypass port, a top edge of which is positioned at or below a top edge of the weir. As the top edge of the bypass port is positioned at or below the top edge of the weirs, any accumulated floatable material in the upper region is able to pass into the lower region before the water level reaches the upper edge of the weir and so does not pass to the outlet chute.

The partition arrangement may further comprise an annular bypass channel fluidically coupling the inlet chute and the outlet chute via the weir. The annular bypass channel may be formed between the central standpipe portion and the surrounding wall of the chamber. The annular nature of the bypass channel maximizes its length and so increases the bypass capacity of the module. The bypass channel may prevent washout of material captured in the lower region during heavy flow conditions.

The annular bypass channel may be open at its top so as to avoid placing any limitation on the bypass capacity of the module. The head room over the weir is thus limited only by the height of the chamber.

The annular bypass channel may be inclined from the inlet chute to the outlet chute. This may prevent material from accumulating on the surface of the partition plate.

The annular bypass channel may be inclined at an angle of 30 to 40 degrees from horizontal.

The weir may comprise a pair of weir plates disposed either side of the outlet chute. Locating the weir plates either side of the outlet chute allows an inlet duct into the chamber to be located at any position about the remainder of the circumference. Accordingly, the separator module can be installed in a wide variety of chambers with different inlet and outlet duct configurations. Moreover, the separator module can support a plurality of inlet ducts and/or inlet ducts of a larger diameter.

The separator module may be installed in a chamber to form a separator.

BRIEF DESCRIPTION OF DRAWINGS

For a better understanding of the present invention, and to show more clearly how it may be carried into effect, reference will now be made, by way of example, to the accompanying drawings, in which.

DETAILED DESCRIPTION

Figure 1:
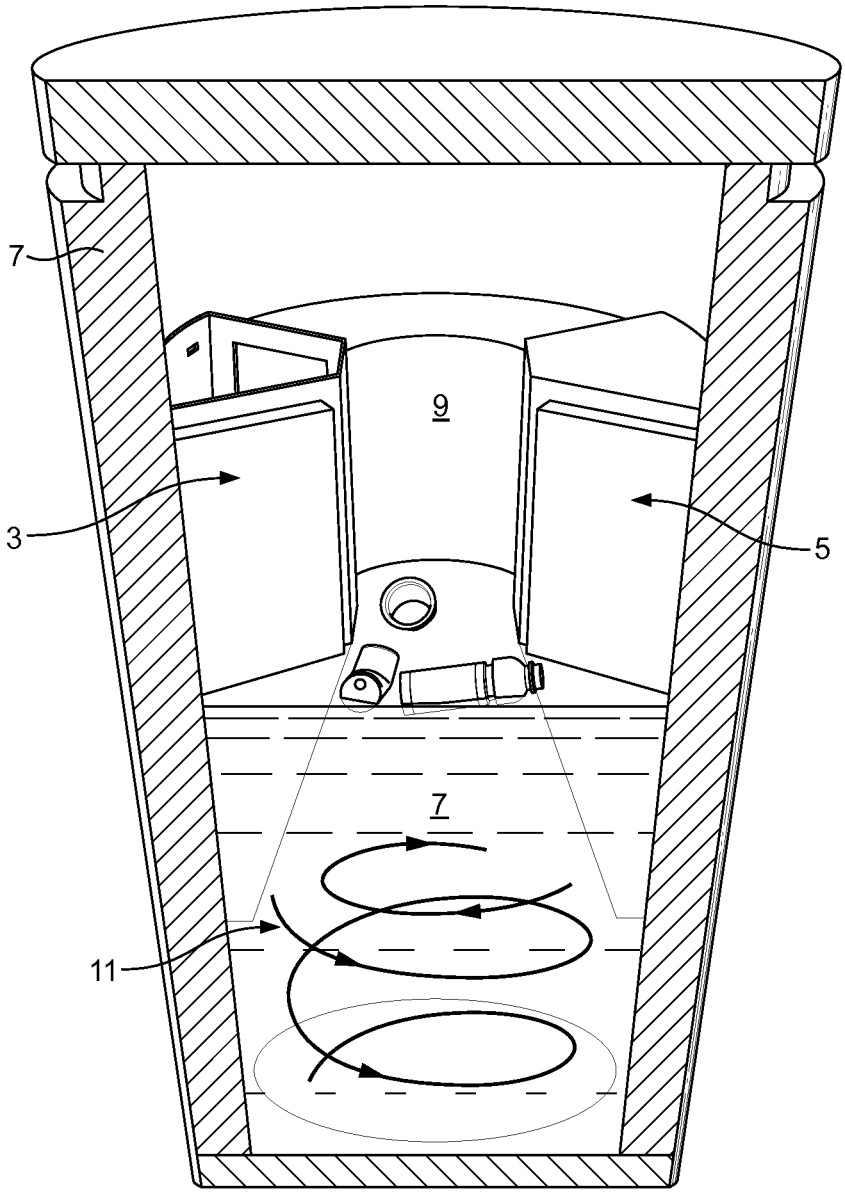
FIG. 1 PRIOR ART
FIG. 1 is a sectional view of a prior art separator.
Figure 2:
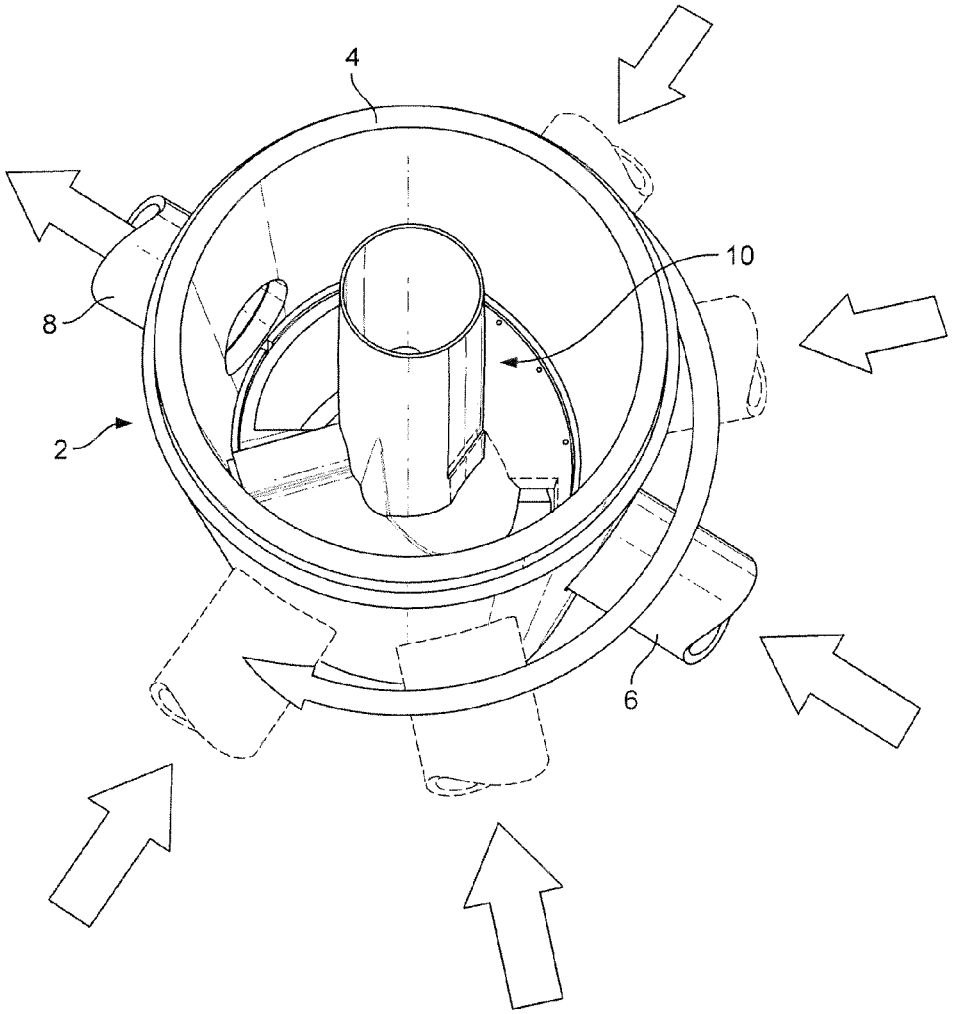
FIG. 2 is a top perspective view of a separator in which a separator module according to an embodiment of the invention is installed in a gully chamber.

FIG. 2 shows a separator which comprises a gully chamber 2 having a cylindrical surrounding wall 4 and top and bottom end walls (not shown for clarity). An inlet duct 6 and an outlet duct 8 open into the surrounding wall 4. An inlet may also be provided in the top wall in a region which is close to the surrounding wall 4 and at a circumferential position which is near to the inlet duct 6. Such an inlet may be positioned in a roadway passing over the separator and covered by a grating.

Figure 3:
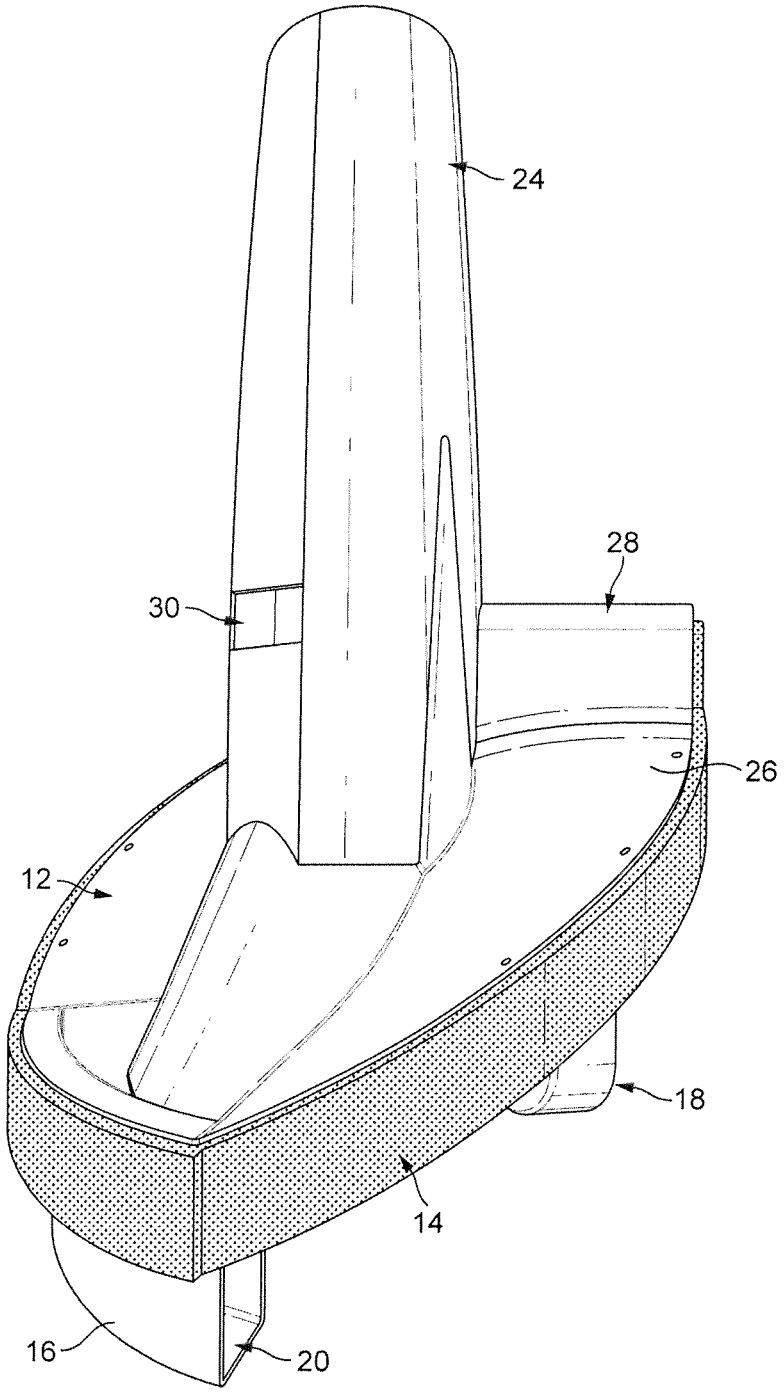
FIG. 3 is a perspective view of the separator module of FIG. 2 alone.
Figure 4:
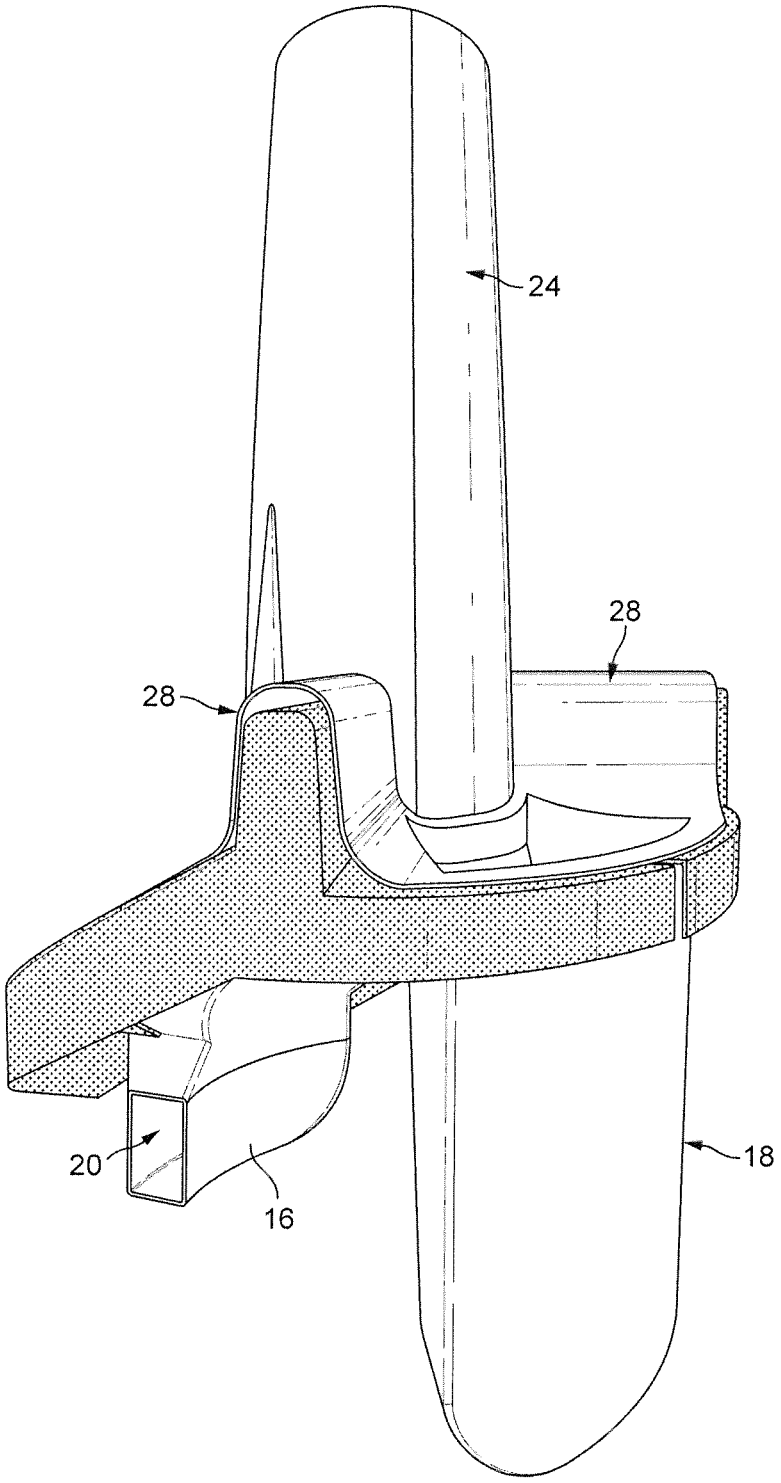
FIG. 4 is another perspective view of the separator module.

A separator module 10 according to an embodiment of the invention is installed in the gully chamber 2. As shown in FIGS. 3 and 4, the separator module 10 comprises a partition arrangement having a partition plate 12 and a separate ledger component 14.

The partition plate 12 divides the chamber 2 into an upper region above the partition plate 12 and a lower region below the partition plate 12.

The partition plate 12 comprises an inlet chute 16 and an outlet chute 18. The inlet chute 16 comprises an opening 20 which provides an inlet to the lower region from the upper region. Similarly, the outlet chute 18 comprises an opening (not shown) which provides an outlet from the lower region to the upper region.

The inlet chute 16 has an arcuate shape which is contoured to conform to the curvature of the inner surface of the surrounding wall 4. The inlet opening 20 is situated close to the internal surface of the surrounding wall 4, and is oriented to direct incoming flow tangentially of the chamber 2. That is, it lies in a plane extending radially with respect to the central axis of the chamber 2.

Likewise, the outlet chute 18 has an arcuate shape which is contoured to conform to the curvature of the inner surface of the surrounding wall 4. The outlet opening is situated close to the internal surface of the surrounding wall 4. The outlet opening is oriented in the same direction as the inlet opening 20 with respect to the circumferential direction around the central axis of the chamber 2.

The inlet chute 16 and outlet chute 18 are positioned in the partition plate 12 so that they are diametrically opposed from one another, with a central standpipe portion 24 disposed therebetween. The central standpipe portion 24 provides access to the lower region of the chamber 2 to allow the chamber 2 to be cleaned out using a standard vacuum tanker, for example. The central standpipe portion 24 also allows air to escape from the lower region as the latter fills with liquid. The central standpipe portion 24 may be cut to suit the headroom available within the chamber 2. The central standpipe portion 24 may be closed at its upper end, for example, by a removable cover.

The partition plate 12 comprises an annular bypass channel 26 defined between the central standpipe portion 24 and the inner surface of the surrounding wall 4. The annular bypass channel 26 fluidically couples the inlet chute 16 and the outlet chute 18 in the upper region.

The inlet chute 16 and the outlet chute 18 are arranged so that the exit from the outlet chute 18 in the upper region of the chamber is located above the entrance to the inlet chute 16. Accordingly, the annular bypass channel 26 is angled and slopes upwards from the inlet chute 16 to the outlet chute 18. The annular bypass channel 26 is inclined at an angle of between 30 and 40 degrees from horizontal.

The annular bypass channel 26 projects upwards either side of the outlet chute 18 to form a pair of weirs 28 which extend radially from the central standpipe portion 24. As shown in FIG. 2, positioning the weirs 28 either side of the outlet chute 18 allows the inlet duct 6 to be disposed at any position about the remainder of the surrounding wall 4. Indeed, this arrangement allows a plurality of inlet ducts and/or larger inlet ducts to be used.

The central standpipe portion 24 is provided with a bypass port 30 which opens into lower region. The top edge of the bypass port is positioned at or below the top edge of the weirs 28. The bypass port 30 may allow air to escape from the lower region where the upper end of the central standpipe portion 24 is closed and sealed.

Figure 5:
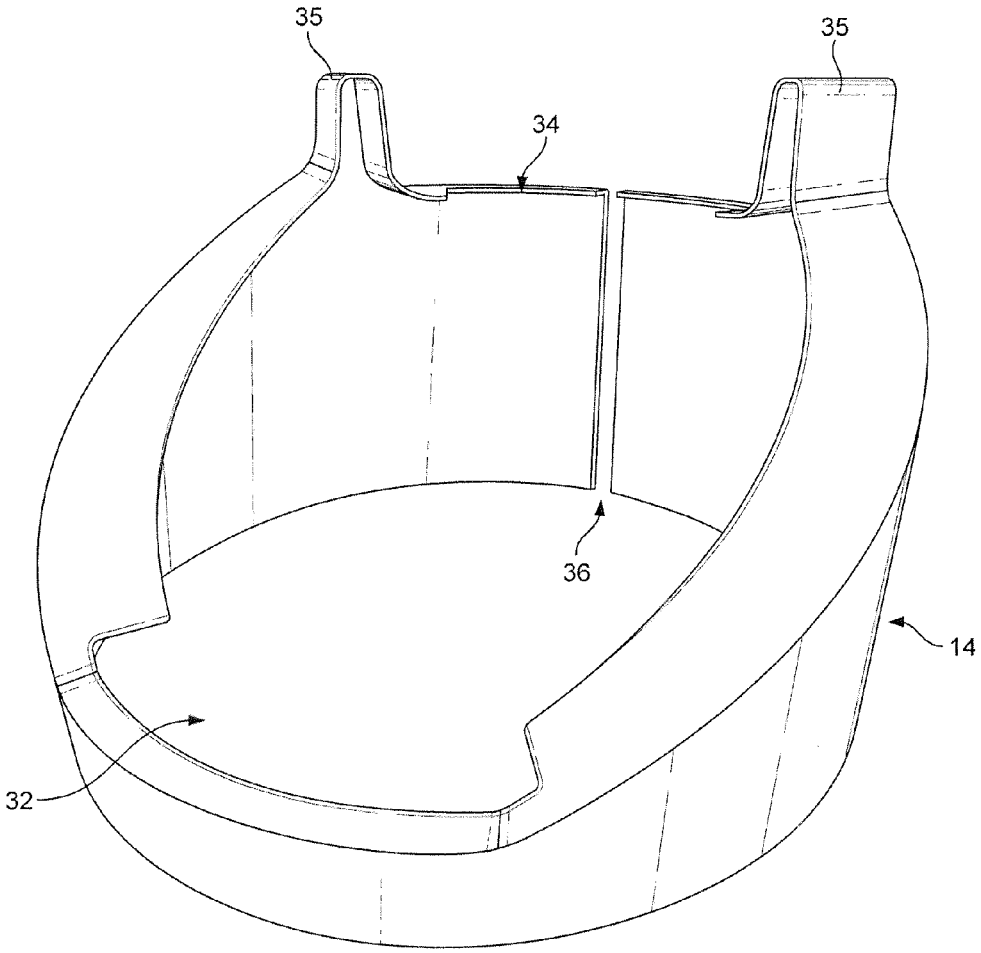
FIG. 5 is a perspective view of a ledger component of the separator module.

Referring now to FIG. 5, the ledger component 14 comprises an annular ring which is configured to be affixed to the inner surface of the surrounding wall 4. The ledger component 14 is designed to support the partition plate 12 within the chamber 2 such that the partition plate 12 does not directly contact the inner surface of the surrounding wall 4.

Accordingly, the ledger component 14 is shaped to conform to the profile of the underside of the partition plate 12. Notably, the ledger component 14 comprises an inlet recess 32 which corresponds to the inlet chute 16 and an outlet recess 34 which corresponds to the outlet chute 18. Between the inlet recess 32 and the outlet recess 34, the ledger component 14 is inclined at the angle of the annular bypass channel 26. The ledger component 14 further comprises a pair of projections 35 which correspond to the weirs 28.

The ledger component 14 has a gap 36 positioned midway across the outlet recess 34. Together with the flexibility of the material used to form the ledger component 14, this discontinuity allows the ledger component 14 to contract so as to reduce its external diameter.

The complementary features of the partition plate 12 and the ledger component 14 interlock the two components so as to prevent rotation of the partition plate 12 relative to the ledger component 14. There is, however, sufficient laxity between the complementary features so as to permit the ledger component 14 to contract by closing the gap 36.

To install the separator module 10, the ledger component 14 is inserted into the chamber 2. Depending on the diameter of the surrounding wall 4, the ledger component 14 may need to be deformed from its rest position to correspond to the inner diameter of the surrounding wall 4 by closing the gap 36. The ledger component 14 is then affixed to the surrounding wall 4 before locating the partition plate 12 thereon.

The gap may also allow the ledger component 14 to expand so as to increase its external diameter.

In use, under low or moderate flow, incoming water flows into the chamber 2 from the inlet duct 6 and enters the inlet chute 16 either directly or having been directed to the inlet chute 16 by the angled annular bypass channel 26. The water passes through the inlet chute 16 and enters the lower region via the inlet opening 20. The flow enters the lower region in a tangential direction and so circulates around the lower region. The flow from the inlet opening 20 will also induce a circulating flow in the water accumulated in the lower region of the chamber 2. This relatively low-energy circulating flow will assist in causing any solids within the incoming flow to accumulate and fall to the bottom of the chamber 2 or rise to the fluid surface depending upon their density. Furthermore, by sweeping past the outlet opening of the outlet chute 18, solids will be less likely to enter the outlet chute 18. The outlet chute 18, and consequently the outlet duct 8, will thus receive substantially clean water.

If the incoming flow rate from the inlet duct 6 increases to a rate above that which can pass through the inlet opening 20, the level in the upper region will rise.

Eventually, it will reach the level of the upper edge of the weirs 28, and will overflow into the outlet chute 18 and the outlet duct 8. Much of the solids material entering the upper region through the inlet duct 6 will pass through the inlet chute 16 and emerge from the inlet opening 20, and so, as before, will tend to fall to the bottom of the chamber 2 or rise to the fluid surface. Nevertheless, under heavy flow conditions, some solid material will pass, with the water, over the weirs 28 into the outlet chute 18, and thence to the outlet duct 8. However, since the main flow within the chamber 2 does not receive the surplus flow passing over the weirs 28, there is less likelihood that the high flow throughput will stir up solids from the bottom of the chamber 2 or from the fluid surface and cause them to enter the outlet chute 18. Moreover, since the top edge of the bypass port 30 in the central standpipe portion 24 is positioned at or below the top edge of the weirs 28, any accumulated floatable material in the upper region is able to pass into the lower region before the water level reaches the upper edge of the weirs 28 and so does not pass over the weirs 28 to the outlet duct 8.

The inclined annular bypass channel 26 prevents material from accumulating on the surface of the partition plate 12. Initial tests have shown that an inclined annular bypass channel provides approximately a 80 to 90% reduction in accumulated solids on the floor of the bypass channel 26, compared to the equivalent level channel.

Figure 6:
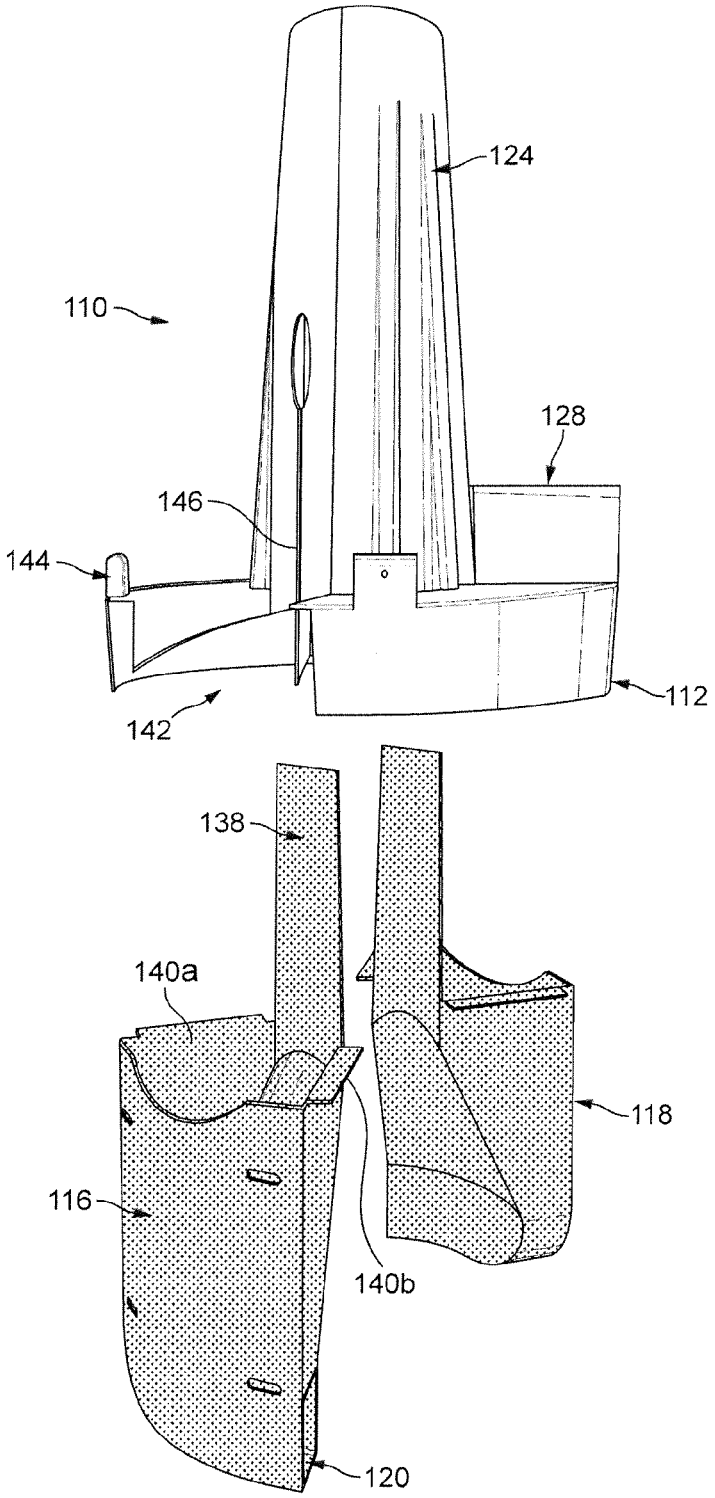
FIG. 6 is an exploded view of a separator module according to another embodiment of the invention.
Figure 7:
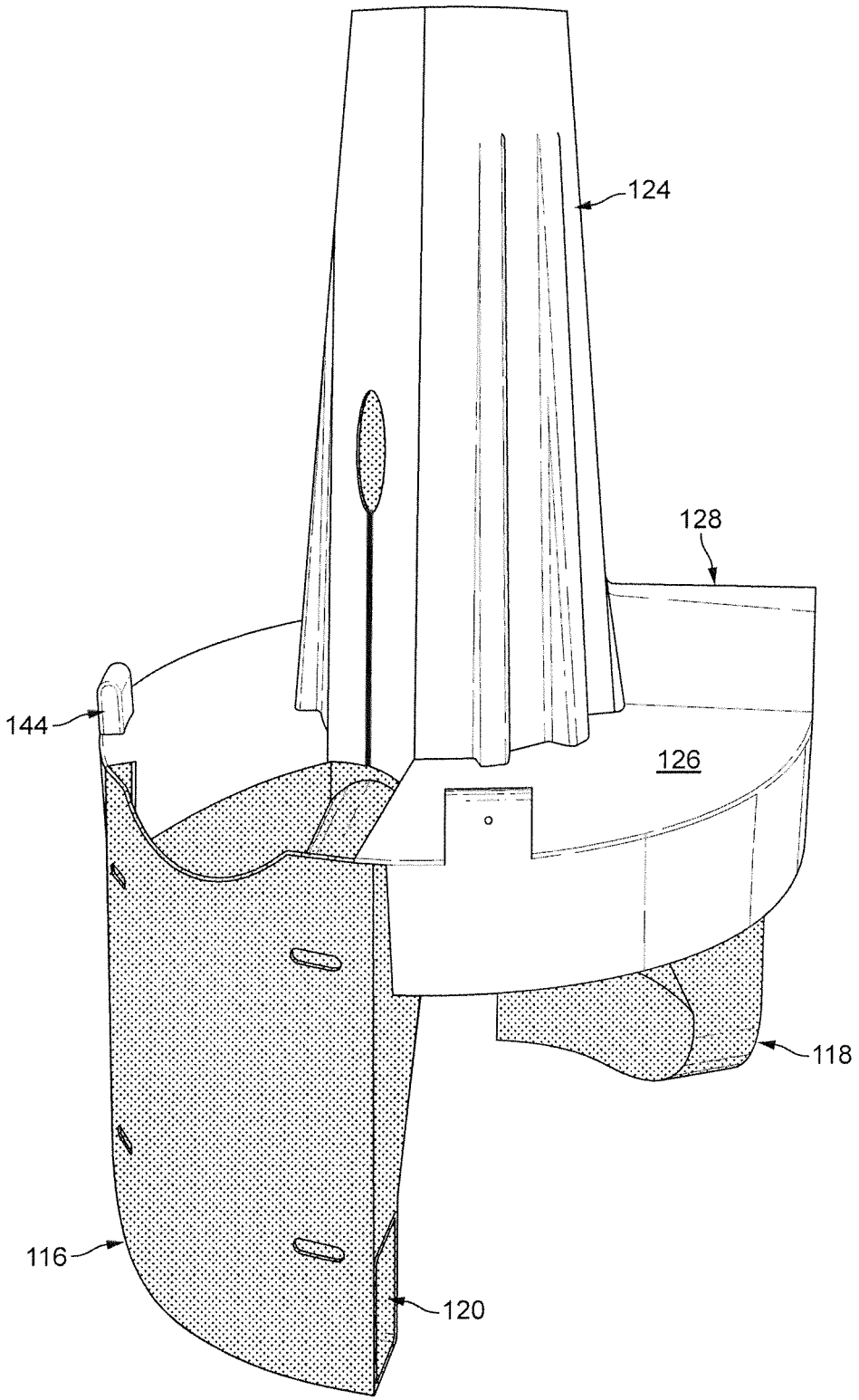
FIG. 7 shows the separator module of FIG. 6 assembled.

FIGS. 6 and 7 show a separator module 110 according to another embodiment of the invention. Although not shown, the separator module 110 may be installed in the chamber 2 described in relation to the previous embodiment.

The separator module 110 comprises a partition arrangement having a partition plate 112. The partition plate 112 divides the chamber 2 into an upper region above the partition plate 112 and a lower region below the partition plate 112.

The partition arrangement further comprises an inlet chute 116 and an outlet chute 118 which are formed as separate components from the partition plate 112.

The inlet chute 116 comprises an opening 120 which provides an inlet to the lower region from the upper region. Similarly, the outlet chute 118 comprises an opening (not shown) which provides an outlet from the lower region to the upper region.

The inlet chute 116 has an arcuate shape which is contoured to conform to the curvature of the inner surface of the surrounding wall 4. The inlet opening 120 is situated close to the internal surface of the surrounding wall 4, and is oriented to direct incoming flow tangentially of the chamber 2. That is, it lies in a plane extending radially with respect to the central axis X of the chamber 2.

Likewise, the outlet chute 118 has an arcuate shape which is contoured to conform to the curvature of the inner surface of the surrounding wall 4. The outlet opening is situated close to the internal surface of the surrounding wall 4. The outlet opening is oriented in the same direction as the inlet opening 120 with respect to the circumferential direction around the central axis X of the chamber 2.

The inlet and outlet chutes components each further comprise a backing plate 138 and first and second circumferential flanges 140*a*, 140*b*, which will be described in more detail below.

The partition plate 112 comprises an inlet recess 142 and an outlet recess (not shown) which are diametrically opposed from one another with a central standpipe portion 124 disposed therebetween. The inlet and outlet recesses are configured to receive the inlet and outlet chute components, respectively.

A keyhole slot 146 opens at the centre of each of the inlet and outlet recesses and extends partway up the central standpipe portion 124. As per the inlet and outlet recesses, the keyhole slots 146 are diametrically opposed from one another and so divide the partition plate 112 into two halves which are joined to one another by the central standpipe portion 124 above the keyhole slots 146.

As shown in FIG. 7, the inlet and outlet chute components are received by the inlet and outlet recesses of the partition plate 112 so that the inlet and outlet chutes 116, 118 are positioned centrally in the inlet and outlet recesses. The inlet and outlet chute components are received from below the partition plate 112, with the backing plates 138 being inserted into the interior of the central standpipe portion 124 so that they cover the keyhole slots 146 formed in the central standpipe portion 124. The circumferential flanges 140*a*, 140*b* abut with and seal against the underside of the partition plate 112. The partition plate 112 comprises an annular bypass channel 126 defined between the central standpipe portion 124 and the inner surface of the surrounding wall 4. The annular bypass channel 126 fluidically couples the inlet chute 116 and the outlet chute 118 in the upper region.

The annular bypass channel 126 projects upwards either side of the outlet chute 118 to form a pair of weirs 128 which extend radially from the central standpipe portion 124. As described previously with respect to the separator module 10, positioning the weirs 128 either side of the outlet chute 118 allows the inlet duct 6 to be disposed at any position about the remainder of the surrounding wall 4. Indeed, this arrangement allows a plurality of inlet ducts and/or larger inlet ducts to be used.

Although not shown, the annular bypass channel 126 may be inclined as per the annular bypass channel 26 of the previous embodiment.

The partition plate 112 may comprise a number of tabs 144 which can be used to affix the separator module 110 to the surrounding wall 4 of the chamber 2. If the (at rest) external diameter of the partition plate 112 is smaller than the internal diameter of the surrounding wall 4, the keyhole slots 146 allow the two halves of the partition plate 112 to be splayed apart in order to increase the external diameter of the partition plate 112 to conform to the diameter of the surrounding wall 4.

The connection of the tabs 144 to the surrounding wall 4 may maintain the two halves of the partition plate in this expanded position. Alternatively, the introduction or connection of the inlet and outlet chute components in or to the inlet and outlet recesses may maintain the partition plate 112 in the expanded position.

The backing plates 138 are of sufficient size so that they cover the keyhole slots 146 even when the partition plate 112 is in the expanded position.

To a lesser extent, the keyhole slots 146 may also allow the two halves of the partition plate 112 to be compressed together in order to decrease the external diameter of the partition plate 112.

As described above, both the separator module 10 and the separator module 110 have mechanisms by which the external diameter of the module can be adjusted so as to conform to chambers having different diameters. This is particularly important where such modules are supplied to both the UK and US markets, with chambers being typically sized based on metric and imperial measurements respectively. The arrangements also provide an improved seal between the precast chamber and the components of the separator module.

The invention claimed is:

1. A separator module for a stormwater gully chamber, the separator module comprising:
- a partition arrangement which, in use, divides the chamber into an upper region and a lower region, the partition arrangement comprising:
  - an inlet chute having an opening which, in use, provides an inlet to the lower region from the upper region;
  - an outlet chute having an opening which, in use, provides an outlet from the lower region to the upper region; and
  - a weir separating the outlet chute from the inlet chute;
- wherein at least a portion of the partition arrangement is flexible so as to allow an external diameter of the partition arrangement to be adjusted to fit different sized chambers;
- wherein the partition arrangement comprises a partition plate and a separate ledger component which, in use, connects to an inner wall of the chamber;
- wherein the ledger component supports the partition plate within the chamber such that the partition plate does not directly contact the chamber, the ledger component defining an external diameter of the partition arrangement; and
- wherein the ledger component comprises a discontinuous flexible annular ring having a gap which allows the ledger component to expand or contract so as to alter the external diameter of the partition arrangement.

2. A separator module as claimed in claim 1, wherein the partition plate and the ledger component comprise complementary structures which interlock with one another.

3. A separator module as claimed in claim 1, wherein the partition arrangement further comprises an annular bypass channel fluidically coupling the inlet chute and the outlet chute via the weir.

4. A separator module as claimed in claim 3, wherein the annular bypass channel is inclined from the inlet chute to the outlet chute.

5. A separator module as claimed in claim 4, wherein the annular bypass channel is inclined at an angle of about 30 to about 40 degrees from horizontal.

6. A separator module as claimed in claim 1, wherein the weir comprises a pair of weir plates disposed either side of the outlet chute.

7. A separator comprising a separator module as claimed in claim 1, installed in the stormwater gully chamber.

8. A separator module for a stormwater gully chamber, the separator module comprising:
- a partition arrangement which, in use, divides the chamber into an upper region and a lower region, the partition arrangement comprising:
  - an inlet chute having an opening which, in use, provides an inlet to the lower region from the upper region;
  - an outlet chute having an opening which, in use, provides an outlet from the lower region to the upper region; and
  - a weir separating the outlet chute from the inlet chute;
- wherein at least a portion of the partition arrangement is flexible so as to allow an external diameter of the partition arrangement to be adjusted to fit different sized chambers;
- wherein the partition arrangement comprises a partition plate and separate inlet and outlet chute components forming the inlet and outlet chutes respectively, the partition plate having first and second openings for receiving the inlet and outlet chute components and an axially extending central standpipe portion disposed between the first and second openings;
- wherein the central portion comprises first and second slots extending axially from the first and second openings; and
- wherein the width of the first and second slots and thus the width of the first and second openings is adjustable so as to alter the external diameter of the partition arrangement.

9. A separator module as claimed in claim 8, wherein the inlet and outlet chute components each comprise a backing plate which is received within the central standpipe portion, the backing plates covering the first and second slots.

10. A separator module as claimed in claim 8, wherein the inlet and outlet chute components each comprise a pair of circumferentially extending flanges which abut the partition plate.

11. A separator module as claimed in claim 8, wherein the central standpipe portion comprises a bypass port, wherein a top edge of the bypass port is positioned at or below a top edge of the weir.

* * * * *